United States Patent [19]

Wood et al.

[11] 4,199,349

[45] Apr. 22, 1980

[54] PRODUCTION OF SPONGE IRON

[75] Inventors: Jonathan R. Wood, Sheffield; George A. Pickin, Guisborough; David S. Harvey, Rotherham, all of England

[73] Assignee: British Steel Corporation, London, England

[21] Appl. No.: 831,401

[22] Filed: Sep. 8, 1977

[30] Foreign Application Priority Data

Sep. 13, 1976 [GB] United Kingdom ..... 37790/76

[51] Int. Cl.[2] ..... C21B 3/04

[52] U.S. Cl. ..... 75/29; 75/25; 75/256

[58] Field of Search ..... 75/256, 3, 25, 29

[56] References Cited

U.S. PATENT DOCUMENTS

| | | | |
|---|---|---|---|
| 2,810,633 | 10/1957 | Cooper | 75/25 |
| 3,770,415 | 11/1973 | Carignani et al. | 75/25 |
| 4,033,778 | 7/1977 | Gilpin | 106/58 |

FOREIGN PATENT DOCUMENTS

| | | | |
|---|---|---|---|
| 2541760 | 3/1977 | Fed. Rep. of Germany | 75/25 |
| 45-7032809 | 10/1970 | Japan | 75/25 |
| 1413346 | 11/1975 | United Kingdom | 75/25 |

*Primary Examiner*—M. J. Andrews

*Attorney, Agent, or Firm*—Jesse B. Grove, Jr.

[57] ABSTRACT

A process for producing feedstock of highly metallized reduced iron from a metalliferrous slurry in which the slurry is subjected to high pressure filtration (9) and the resultant filter cake is then broken up and fed into a kiln (10) for firing together with a reductant.

The slurry may be ferruginous waste products from ironmaking/steelmaking processes i.e. in-plant fines and additions may be made to the slurry (1 to 7) to aid the reduction stage of the process or to aid the agglomeration stage.

12 Claims, 4 Drawing Figures

38
35
33
31
28
36
30
37
27
24
26
25
30
33
36
29
32
34

PRODUCTION OF SPONGE IRON

This invention relates to a process for producing a reduced iron (sponge iron) from metalliferous slurries e.g. for use in a blast furnace burden or as a raw material for steelmaking.

From one aspect, the invention provides a process for producing feedstock of highly metallised reduced iron from a metalliferous slurry, comprising subjecting the slurry to high pressure filtration, breaking up the resultant filter cake and feeding these cake components into a kiln for firing, together with a reductant, whereby to produce the said feedstock.

The slurry may be ferruginous waste products from ironmaking/steelmaking processes, i.e. in-plant fines, or the slurry may be the product of iron extraction processes from its ore, e.g. an iron ore slurry obtained from concentration processes; the invention also embraces a chrome ore slurry which may likewise be obtained in this manner.

Preferably, additions are made to the slurry either to aid the reduction stage of the process, e.g. lime and/or a solid reductant (coke or coal), or to aid the agglomeration stage, e.g. bentonite. Rolling mill waste, i.e. mill-scale, may also be added at the slurry stage. These additions to the slurry will form a composite filter cake.

The high pressure filter may conveniently be of dual chamber design defined by two concentric cylinders, the slurry being pumped into the outer annulus thus formed and compressed therein to define an annular filter cake which is then broken up on withdrawal. Two-step pressure filtration may be performed in the outer annulus to obtain the high degree of compression required on the 'green' cake which must be sufficient to render it handleable.

Alternatively, a vertically operable high pressure filter of the tube press type may be employed.

Hitherto, various forms of pelletising such slurries have been proposed involving the steps of drying and blending before moisturising and pelletising the resultant mix, following which the pellets were reduced in a kiln. Compared with the process in accordance with this invention however, the steps of drying for mixing, moisturising and pelletising are avoided and substituted by a simple wet mixing process followed by high pressure filtration.

With the pelletising process there are limitations on the size of the particles in the blend. Such limitations are not so stringent in accordance with our invention where there is less need for comminution of input material. The metallurgical advantages which ensue from our route are that alkalis are removed from the slurry in the filter wash water giving a lower alkali content in the metallised product, and the greater particle size of reductant (coke or coal) tolerated by the high pressure filter permits a greater degree of latitude in this area which is advantageous insofar as the smaller specific surface area of the larger particle size of reductant gives rise to a slower and more controlled reaction between the reductant and the oxide at the onset of reduction. Further, the proportion of reductant added can be appreciably greater than the nominal 10% limitation on the initial blend carbon content in the pelletising route, and this gives rise to a higher degree of removal of tramp elements during the reduction phase, e.g. zinc, sodium, potassium, and greater metallisation, and may give rise to a less friable filter cake.

In order that the invention may be fully understood, one embodiment thereof will now be described, by way of example, with reference to the accompanying drawings in which.

Figure 1:
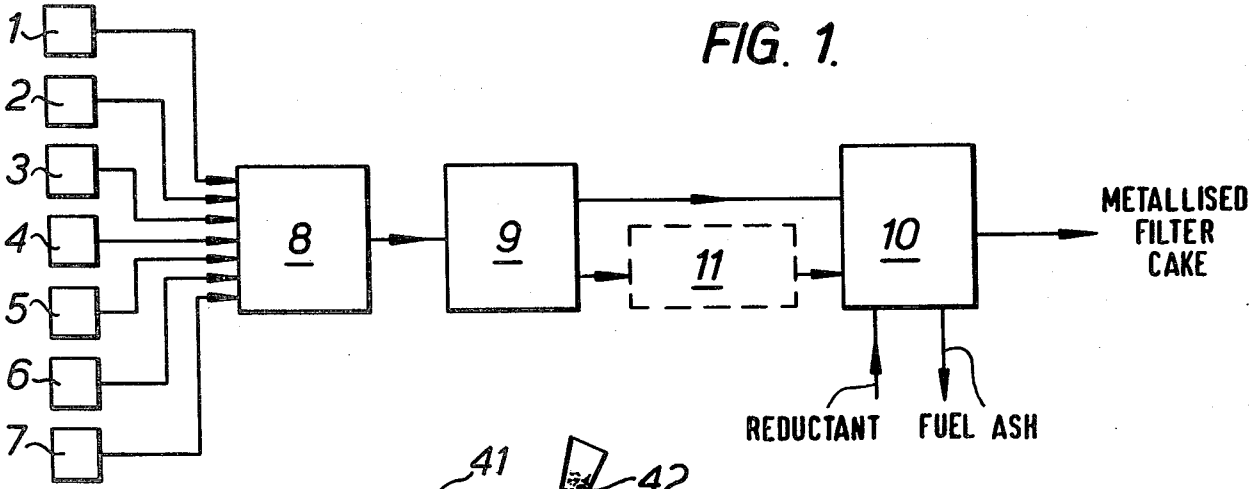
FIG. 1 is a schematic diagram of the process route in accordance with this invention.

Referring now to FIG. 1, a plurality of hoppers are provided for storing the input materials to be blended. Purely by way of example five hoppers (1 to 5) are shown separately to accommodate arc furnace dusts from various steelworks, either in sludge or powder form, basic oxygen system waste slurries and other in-plant fines as described. Hopper 6 provides a particulate coke addition to aid reduction, and hopper 7 provides a slaked lime addition primarily to aid filter cake strength in the green state; both additions are in powder form in this example.

Selected quantities from these hoppers are fed to a simple mixer 8 comprising a rotatable blade and a heater, e.g. a steam coil heater; provision also exists for water to be added to the mixture, as required, depending on the moisture content of the constituents. Specific blends are discussed later.

The slurry from the 'wet' mixer 8 is fed to a high pressure filter 9, the 'green' filter cake output from which is broken up and fed to a rotary kiln 10 either directly or after drying in a drier 11. The smaller size fractions may be screened out and recycled.

The output from the kiln is a highly metallised agglomerate suitable for use, for example, in a blast furnace without any further processing.

Figure 2:
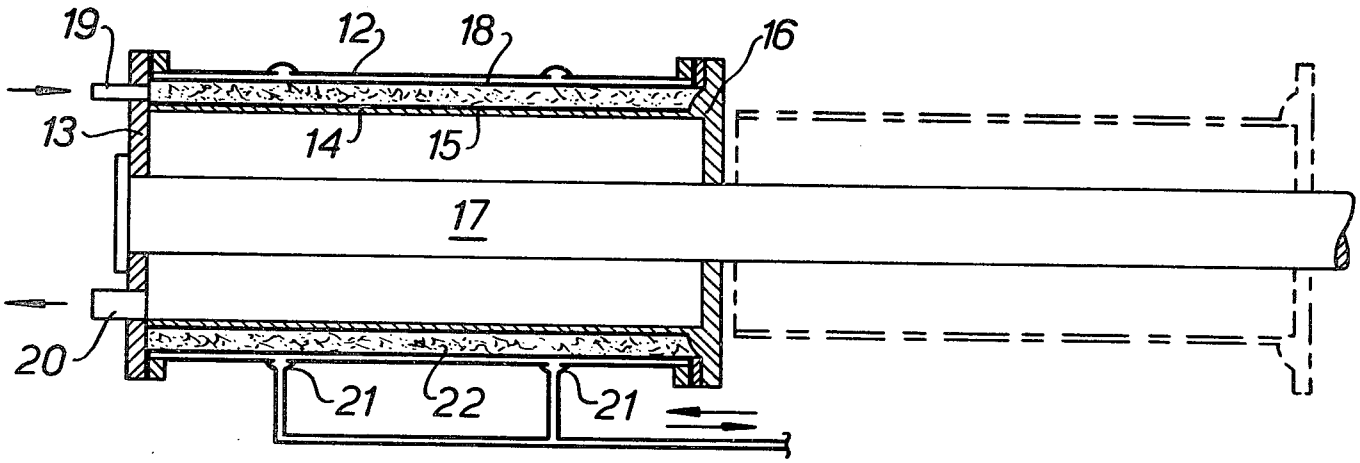
FIG. 2 is a sectional elevation of one form of high pressure filter used in this process.

The high pressure filter 9 may conveniently be of the variable chamber type depicted in FIG. 2.

Referring now to this figure the filter comprises an outer cylinder 12 sealed by an apertured end cap 13 and a perforated inner cylinder 14 around which a filter cloth 15 is wrapped, an end cap 16 being secured to this cylinder and carried on a central spindle 17.

An elastomeric membrane 18 is secured around the inside of the outer cylinder and an inlet 19 for the slurry is provided to communicate with the annulus defined between this membrane and the inner cylinder, whilst an outlet 20 for the drain liquour is provided in the end cap 13 within this cylinder.

Hydraulic fluid is applied around the outer surface of the membrane via two annular channels 21 in the cylinder 12.

In operation, the slurry is pumped at say 80 p.s.i. through the inlet 19 and a preliminary filtration is effected. The thickness of the filter cake (22) may be controlled by limiting the pumping time during this stage. The cake is then further compressed by applying hydraulic fluid to the membrane through the channels 21, compressing the cake at up to say 200 p.s.i. removing further moisture and producing an annulus of green cake.

On release of the high pressure, the inner cylinder is withdrawn into the position shown in dotted outline, drawing with it the core of green cake which is then broken off the cylindrical sleeve by e.g. compressed air. The cake is strong enough to be readily handleable at this stage.

In order to aid breakage on removal and produce consistently sized pieces of filter cake the filter cloth may have a mesh or net wound around it so that regularly patterened impressions are formed in the compressed cake.

For a given blend and filtration time, the mass of cake yielded increases with increasing temperature of the input slurry. Temperatures of between 20° C. and 60° C. can readily be accommodated.

Figure 3:
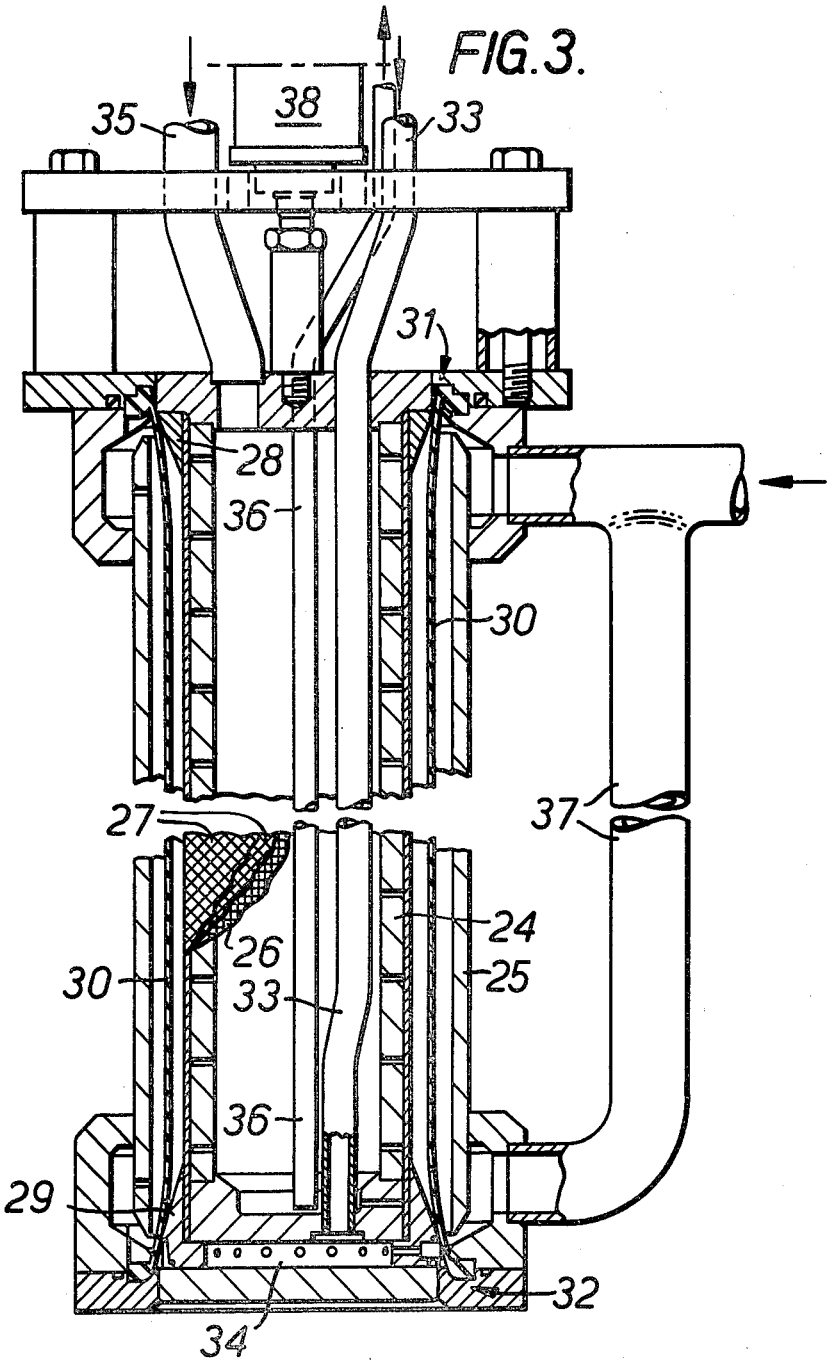
FIG. 3 is a sectional elevation of another form of high pressure filter.

An alternative form of high pressure filter, in the form of a tube press, is illustrated in FIG. 3. In this design a perforated tube 24 is disposed centrally within a vertically mounted tubular casing 25. A metallic filter mesh 26 closely fits around tube 24 and this supports filtration cloths 27 which are secured to upper and lower fairings 28, 29; an elastomeric bladder 30 is secured at its upper and lower ends to terminal assemblies 31, 32 secured to the casing 25. A slurry pipe 33 extends down through the tube 24 and terminates in a distribution chamber 34 embodying one-way valves by which the slurry may be injected between the inner wall of the bladder and the filtration cloths. An air blast pipe 35 projects into the top of the tube cavity, and a filtrate outlet pipe 36 likewise projects into this cavity, but this one terminates adjacent the tube bottom; hydraulic feed pipes 37 are coupled through the casing 25. Finally, a power cylinder 38 surmounts the tube 24, a piston drive through which is operative axially the displace the tube for discharging the filter cake.

In operation, a specific quantity of slurry is pumped through the pipe 33 and partially fills the cavity defined between the bladder and the filtration cloths. Hydraulic fluid is then applied via feed pipes 37 and the slurry is compressed under a pressure of say 1500 p.s.i. The filtrate percolates through the walls of the tube 24 and is removed through the pipe 36 under the action of air pressure applied through the pipe 35; an annular 'cake' is formed around the outer circumference of the tube 24. The hydraulic fluid is then discharged and the resulting space evacuated causing the bladder to cling to the inner walls of the casing and the filter cake is removed by depressing the tube downwardly so that it projects beyond the lower terminal assembly 32 and by then applying high pressure air blasts through the pipe 35.

Figure 4:
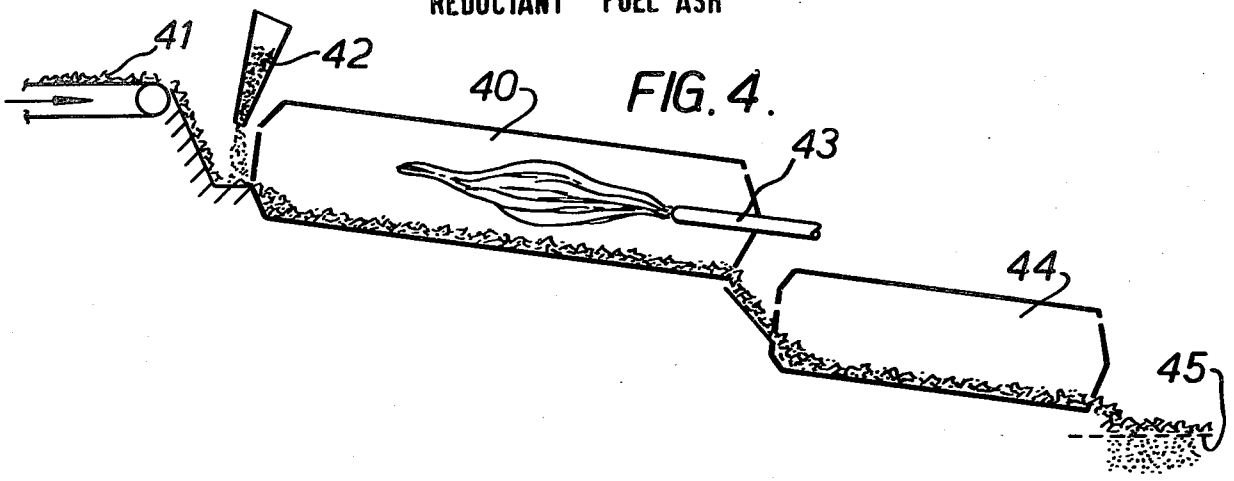
FIG. 4 is a sectional elevation of a typical rotary kiln system used in this process.

The tube 24 is then retracted and the cycle repeated. The rotary kiln, to which the broken cake is transported, may be of the type shown in FIG. 4.

More particularly, the kiln comprises an inclined hollow cylinder 40 into the upper end of which is fed the filter cake pieces 41 together with a solid fuel reductant (coal and/or coke) 42. A gas or oil fired lance 43 extends into the lower end of the kiln which is slowly rotated as the burden migrates downwardly, metallising the filter cake into a sponge iron. In particular, the lance is used to initiate the kiln campaign and give occasional fine temperature control during the run. The solid fuel reductant is the main fuel and air is blown into the kiln from the discharge end and this burns with the main fuel to heat the kiln. The material discharged from the kiln, which is a mixture of sponge iron, surplus fuel and ash, is then passed through a rotary cooler 44 and the sponge iron granules are then separated from the residue by a screen 45.

The process according to this invention has been performed with a number of different blends based on a 70:30 mixture, by dry weight, of arc furnace dust and BOS slurry, the blends differing in the proportions of coke and slaked lime which they contained, the coke in turn influencing the carbon content.

Table 1, below, identifies three typical blends containing arc furnace fines from five different sources together with a BOS slurry.

TABLE 1

| Material | Condition | Moisture % | % Wet Material Used in Each Blend: Blend 1 | Blend 2 | Blend 3 |
|---|---|---|---|---|---|
| Arc Dust | Sludge | 20.1 | 13.0 | 9.1 | 8.5 |
| Arc Dust | Powder | 2.7 | 10.5 | 7.0 | 6.6 |
| Arc Dust | Sludge | 44.6 | 10.3 | 7.0 | 6.8 |
| Arc Dust | Sludge | 31.1 | 6.2 | 5.3 | 3.9 |
| Melting Shop Roof Extraction | Wet Powder | 14.5 | 6.2 | 3.3 | 4.4 |
| BOS Slurry | Slurry | 81.7 | 53.8 | 62.5 | 57.7 |
| Coke | 100%–0.5 mm | 0 | NIL | 3.2 | 9.4 |
| Slaked Lime | Powder | 0 | NIL | 2.6 | 2.7 |

In turn, data are reproduced below on the physical aspects of the metallisation of the filter cake derived from these three blends (Table 2) and the degree of metallisation and the removal of elements in different size fractions (Table 3).

TABLE 2

| Blend No. | Input Material: Filter Cake (g) | Coke (g) | Input Size Fractions of Cake (%): +16.0 mm | 13.2 to 16.0 mm | 11.2 to 13.2 mm | 8.0 to 11.2 mm | Output Size Fractions of Metallised Cake (%): +16.0 mm | 13.2 to 16.0 mm | 11.2 to 13.2 mm | 8.0 to 11.2 mm | 5.6 to 8.0 mm | 1.0 to 5.6 mm | −1.0 mm | Derived Data: Degradation % | Magnetic Yield % | Non Magnetic Yield % |
|---|---|---|---|---|---|---|---|---|---|---|---|---|---|---|---|---|
| 1 | 1000 | 260 | 40.6 | 3.0 | 2.2 | 4.2 | 62.1 | 12.0 | 9.3 | 6.8 | 4.3 | 3.8 | 1.7 | 5.5 | 70.9 | 57.9 |
| 2 | 1000 | 180 | 85.4 | 2.3 | 5.2 | 7.1 | 41.5 | 17.0 | 10.7 | 12.3 | 10.3 | 6.3 | 1.9 | 8.2 | 60.3 | 75.8 |
| 3 | 1000 | 140 | 77.5 | 8.3 | 5.0 | 9.2 | 53.9 | 8.8 | 11.8 | 13.2 | 7.3 | 2.8 | 2.2 | 5 | 62.7 | 86.1 |

TABLE 3

| Blend No. | Initial Carbon % | +16.0 mm: Metallization % | Element removal %: Zn | Pb* | Na | K | +8.0 mm: Metallization % | Element removal %: Zn | Pb* | Na | K | +1.0 mm: Metallization % | Zn removal % | Pb removal % |
|---|---|---|---|---|---|---|---|---|---|---|---|---|---|---|
| 1 | 1.5 | 76.1 | 62.3 | 32.9 | 57.7 | >95 | 95.6 | 87.4 | 55.4 | 81.9 | >95 | 98.8 | 79.6 | 81.4 |
| 2 | 8.8 | 99.4 | 98.0 | 32.1 | 57.1 | >50 | 99.4 | 99.4 | 41.8 | 73.3 | >50 | 99.0 | 98.9 | 86.8 |

TABLE 3-continued

| Blend No. | Initial Carbon % | +16.0 mm Metallization % | +16.0 mm Element removal % Zn | Pb* | Na | K | +8.0 mm Metallization % | +8.0 mm Element removal % Zn | Pb* | Na | K | +1.0 mm Metallization % | +1.0 mm Zn removal % | +1.0 mm Pb removal % |
|---|---|---|---|---|---|---|---|---|---|---|---|---|---|---|
| 3 | 14.1 | 99.3 | 99.7 | 30.2 | 74.5 | 91.8 | 99.3 | 99.3 | 45.2 | 79.1 | 91.9 | 90.9 | 91.9 | No removal |

*A greater degree of lead removal can be expected from commercial operation

The above results were derived with the process operating with a three hour firing period in the kiln at a temperature of about 1050° C. 'Metallisation' is defined as the ratio of metallic iron in the fired granules to the total iron (including iron content of iron oxide) and 'degradation' is defined as the ratio of the magnetic weight of the −5.6 mm fraction to the total magnetic weight.

The above tables are specific to the blends mentioned but in general a typical analysis of elements in the three stages of the process is listed below in Table 4.

TABLE 4

| Element | Arc Furnace Fume | Fume Filter Cake | Metallised Output |
|---|---|---|---|
| $Fe^{total}$ | 25%–50% | 25%–50% | 40%–80% |
| Gangue Materials | 10–30% | 10–30% | 10–35% |
| C | <4% | <20% | <5% |
| S | <2% | <2% | <2.0% |
| $P_2O_5$ | <2% | <2% | <2.0% |
| Zn | 7–25% | 7–25% | <1.0% |
| Pb | 1.5–10% | 1.5–10% | <0.5% |
| $Na_2O$ | <5% | <2% | <1% |
| $K_2O$ | <2% | <1.0% | <0.5% |

References to the 'metallurgical' advantages, together with others arising from the process according to this invention, have already been made in this specification but, compared with the pellet process route, these results offer a very close similarity with that practice. Blend 3 however, which contains a higher carbon level than can be accommodated in the pellet route, gives a higher removal of zinc than is possible with pelletising. Basicity is also generally higher, and this aids reduction size, in the pellet route, significant lime additions are required to achieve sufficient basicity to stop slag phases forming during reduction and these slags tend to coat the pellet to the detriment of zinc, lead and alkali removal, and of metallisation.

Although the invention has been described with reference to the specific embodiment illustrated, it is to be understood that various modifications may be made without departing from the scope of this invention. For example, other forms of high pressure filter may be adopted, higher pressures than those mentioned may be achieved, and reduction may be effected in a different form of kiln from that shown; magnetic separation may also be performed on the kiln discharge material. The filter cake input to the kiln may be pre-heated and the composition of this cake may be varied, e.g. iron ore fines may be charged to the mixer together with the arc dust etc.

We claim:

1. A process for producing feedstock of highly metallized reduced metal which comprises the steps of preparing a slurry of metalliferous particles, subjecting the slurry to high pressure filtration at a pressure of at least about 200 p.s.i. to produce a filter cake of said metalliferous particles, breaking up said filter cake into pieces, adding a reductant to said filter cake pieces, feeding the filter cake pieces together with said reductant into a kiln, and reducing said metalliferous particles in said kiln whereby to produce said feedstock.

2. A process according to claim 1, in which the slurry is prepared from ferruginous waste products from ironmaking or steelmaking processes.

3. A process according to claim 2, in which the slurry is dispensed from storage hoppers, and the dispensed materials are mixed together in a mixer before being subjected to high pressure filtration.

4. A process according to claim 3, in which coke and lime additions are made to the mixer to aid reduction and agglomeration, respectively.

5. A process according to claim 4, in which the filter cake is dried before feeding into the kiln.

6. A process according to claim 5, in which the filter cake is pre-heated before charging into the kiln.

7. A process according to claim 4, in which the filter cake has a patterned impression formed in it to aid its breakage.

8. A process according to claim 1, in which the slurry is prepared from the waste products obtained from the iron extraction from its ore.

9. A process for producing a feedstock of highly metallized reduced iron which comprises the steps of preparing a slurry of metalliferous particles derived from mixed waste products from steelmaking processes, injecting said slurry of mixed waste products into a high pressure filter operating at a pressure of at least about 200 p.s.i. whereby to produce a filter cake, breaking up said filter cake into pieces, adding a reductant to said pieces, charging said pieces of filter cake together with said reductant into a kiln and reducing said metalliferous particles in said kiln whereby to produce said feedstock.

10. A process according to claim 9 in which millscale is dispensed into the mixer in addition to said waste products.

11. A process according to claim 1, in which a reductant is added to said slurry prior to said high pressure filtration of said slurry.

12. A process according to claim 2, in which said high pressure filtration takes place at a pressure of at least 1500 p.s.i.

* * * * *